US007628149B1

(12) United States Patent
Zarecky et al.

(10) Patent No.: US 7,628,149 B1
(45) Date of Patent: Dec. 8, 2009

(54) VARIABLE BORE PAINTBALL BARREL CONNECTOR SYSTEM

(75) Inventors: Victor Karl Zarecky, Crystal Lake, IL (US); Joshua George Zarecky, Crystal Lake, IL (US)

(73) Assignee: Summit Fitness Products Incorporated, Crystal Lake, IL (US)

( * ) Notice: Subject to any disclaimer, the term of this patent is extended or adjusted under 35 U.S.C. 154(b) by 331 days.

(21) Appl. No.: 11/197,189

(22) Filed: Aug. 4, 2005

Related U.S. Application Data

(60) Provisional application No. 60/603,652, filed on Aug. 23, 2004.

(51) Int. Cl.
*F41B 11/00* (2006.01)

(52) U.S. Cl. ..... 124/85; 124/58; 124/73; 124/83; 124/84

(58) Field of Classification Search ..... 124/58, 124/73, 74, 75, 76, 77, 81, 85, 83, 84
See application file for complete search history.

(56) References Cited

U.S. PATENT DOCUMENTS 5,228,427 A * 7/1993 Gardner, Jr. ..... 124/71
6,273,080 B1 * 8/2001 Sullivan, Jr. ..... 124/84
6,494,195 B2 * 12/2002 Perry et al. ..... 124/84
6,668,815 B1 12/2003 Fernandez
6,698,128 B2 * 3/2004 Kessler ..... 42/76.01
6,823,857 B2 11/2004 Perry et al.
7,076,905 B2 * 7/2006 Zouboulakis ..... 42/76.01
2001/0050077 A1 12/2001 Sullivan, Jr.
2002/0179074 A1 12/2002 Sullivan, Jr.

OTHER PUBLICATIONS

Image from website on Jul. 15, 2004: http://images.actvil.com/images/eCS/Store/en/images/large/012-130-0101.jpg.
Image from website on Jul. 15, 2004: http://images.actvil.com/images/eCS/Store/en/images/large/012-7113.jpg.
Image from website on Jul. 15, 2004: http://www.paintballfirst.com/item_images/735332_BIG.jpg.
Image from website on Dec. 9, 2007: http://www.pbreview.com/products/reviews/4068/.
Magazine advertisement from Action Pursuit Games; Jan. 2005; p. 185.
Magazine advertisement from Action Pursuit Games; Apr. 2003; p. 219.

(Continued)

*Primary Examiner*—J. Woodrow Eldred
(74) *Attorney, Agent, or Firm*—Banner & Witcoff, Ltd.

(57) ABSTRACT

This apparatus is a variable bore paintball barrel connector system. with a one-piece connector unit that joins the paintball marker with any mating barrel, regardless of manufacturer, at least one removable cylindrical compression sleeve that is inserted into the one-piece connector to provide the chosen compression to the paintball, thereby creating an optional compression zone, acting as an independent device that is not an incorporated component of any barrel nor marker unit, it allows for quick and easy transitions between the use of compression or no compression, and the compression sleeve has a raised lip on one edge that holds it in place and prevents it from slipping through the connector device.

14 Claims, 4 Drawing Sheets

OTHER PUBLICATIONS

Magazine advertisement from Action Pursuit Games; Apr. 2003; p. 175.

Magazine advertisement from Action Pursuit Games; May 2004; p. 83.

Precision define your game Archon advertisement.

If your barrel sucks, then you are only pretending to be a SNIPER advertisement, unknown magazine and date.

Wipe off your goggles and . . . PHAT Performance Barrel System advertisement.

* cited by examiner

VARIABLE BORE PAINTBALL BARREL CONNECTOR SYSTEM

CROSS REFERENCE TO RELATED APPLICATIONS

This application is based on provisional application Ser. No. 60/603,652, filed on Aug. 23, 2004.

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION

This invention relates generally to the field of the fast paced sport of paintball and more specifically to the equipment used in the nuances of the sport; this apparatus contributes a variable bore paintball barrel connector system.

In the game of paintball, the paintball player must not only carry with him, his marker, and propellant supply, as well as any extra paintballs. He may need to use a squeegee for clearing broken balls, and many other items. The ability to perform any required task in the shortest amount of time, while being under fire by opponents in a constantly changing environment, only magnifies the need for simple quick solutions or adjustments to his equipment.

Several forms of paintball barrels with built-in compression chokes are known in the art. Known choke barrels are defined by a barrel configuration whereby a choke of a specific design is permanently incorporated into each distinct barrel and cannot be used independently of that barrel system. Likewise, choke barrels of prior art are of no use, and will either allow the gas being used as the propellant to prematurely escape around the paintball, or more often puncture the paintball if used without their specific choke installed.

As for example, choke barrels are disclosed in U.S. Pat. Nos. 2,003,290; 2,117,935; 5,228,427; 6,273,080; 6,295,752; and 6,494,195. However, known paintball barrels with built-in compression chokes, and the common standard barrels, which are of a predetermined bore size and do not incorporate using, or in any way integrate, any compression have several disadvantages that are solved by the present invention. A singular integrated compression choke barrel limits the user's ability to not only adapt to the constantly changing environment encountered while using a paintball marker, but also requires the user to apply some form of compression to the paintball at all times, and under all conditions. Hence, this restricts the user of an integrated choke barrel to the particular barrel design of a specific barrel manufacturers model. Any advantage that could have been gained by providing compression to the paintball may be limiting the user of the paintball marker from the ability to take full advantage of the multitude of other barrels. Other barrels can offer varying lengths, shapes, and exhaust hole configurations, or materials in their construction. These types of barrels are offered by several manufacturers and are commonly known as fixed bore barrels, that do not incorporate a compression choke into the barrel, however their specificity addresses other advantages.

A major disadvantage of the integrated type choke barrel is that a paintball, which consists of a round membrane filled with paint, may vary in size from 0.675 to over 0.690 in diameter, as measured by the manufacturer in a controlled environment. There are not only a multitude of manufacturers producing paintballs, but each often produces an array of paintball types and sizes. Paintballs are subject to constant changes in temperature or other stresses from the environment when in use. For example, if a paintball of a large caliber .690+ is being used with an integrated choke barrel and the temperature rises, the balls will expand in size this may result in a situation where the paintball no longer requires compression. The person using an integrated choke barrel must either remove the choke from its mating barrel increasing the chance of the paintball breaking due to the irregular internal shape left within the choke-integrated barrel, or continue using the integrated compression choke, which also bears the high risk of breaking paintballs, based on the increased pressures being applied to the paintball.

It is the combination of a number of different factors involved when using a paintball marker that when combined together in different degrees under each unique situation will determine the final effect on the accuracy and distance of the paintball after it leaves the marker, including: size of the paintball; amount of compression applied; length of the barrel; amount and pattern of the exhaust holes incorporated into the barrel, the propellant being used; as well as, wind, temperature of the environment or other environmental factors. Therefore, the lack of adjustability, or the requirement of having to apply some degree of constant compression to the paintball when using an integrated compression choke barrel can be a significant and limiting problem when attempting to achieve the best possible results.

In contrast to the known art, the variable bore paintball barrel connector system of the present invention is designed to be a self-contained unit so that when the one piece connector is removeably attached to the paintball marker, often referred to as a gun, and the desired compression sleeve is inserted, it will create an optional compression zone whereby the user of the paintball marker can then connect any paintball barrel of a compatible mating-design configuration. The present invention focuses soley on providing compression to the paintball, and does not provide an integrated paintball marker or barrel.

The user of the present invention can easily choose to change the amount of compression applied to the paintball and reconnect the same barrel or connect a different barrel design, i.e. length, shape or exhaust hole pattern, to the mating end of the one-piece connector, opposite the end that attaches to the marker, as necessary, depending on the situation, to optimize usage flexibility, individual preferences, or conditions. Most importantly, the present invention, by the nature of its design, allows the user the ability to just as quickly remove the entire one-piece connector and compression sleeve from the paintball marker and reconnect a barrel directly to the paintball marker thereby completely removing the optional compression zone, as required when the environment of the paintball game no longer necessitates compression be applied to the paintball.

The cross use of various manufacturers' barrels, whether or not intended to incorporate compression, is now possible, therefore having a greater selection between the assortments of barrel design configurations available for attachment to paintball markers. Despite having no standardized mating configuration between the varying manufacturers, the present invention can be adapted to accommodate for these differences.

BRIEF SUMMARY OF THE INVENTION

The primary object of the invention is an independent device that is not an incorporated component of a barrel nor a marker unit.

The apparatus of the present invention is a one-piece barrel connector unit comprising at one end, an external portion of a design configuration allowing it to be removably attached to the mating internal bore of a paintball marker. This same end of the connector, having the external portion, also has a centered internal through-hole of a size that will allow a compression sleeve to be removably inserted into the connector. This through-hole is smaller than the internal bore that is located at the opposite end of the connector, being of a design configuration that will allow a paintball barrel of the same mating configuration to be attached to the internal bore of the connector at this end. This creates an optional compression zone now located between the paintball maker body and the paintball barrel, and joins these components.

Another object of the invention is it allows the user to vary paintball compression as needed.

The cylindrical compression sleeve also has an internal through-hole, which will apply a pre-determined amount of compression against the paintball as it travels through the compression sleeve. When a paintball is ejected from the paintball marker, it will first travel through the compression sleeve, which will apply compression against the paintball before it enters the paintball barrel. The size of the through-hole of the compression sleeve being used determines what amount of compression is applied.

This invention offers at least two cylindrical insertable-removable axially aligned, axially centered compression sleeves. Each removable compression sleeve has an internal through-hole, and each is of a size that is different than any other selectable compression sleeve. Each removeable compression sleeve may be inserted from either end into the through-hole of the one-piece barrel connector up to the compression sleeve shoulder. This allows each compression sleeve, while inserted inside the one-piece connector, the ability to produce a different, yet predetermined, amount of compression against the paintball as it passes through the variable bore paintball barrel connector system.

Another object of the invention is it offers a range of compressions that can be secured in place.

The insertable cylindrical compression sleeve will be used in conjunction with the one-piece barrel connector. The compression sleeve has a shoulder that is larger than its outside diameter so that the compression sleeve can only be inserted into the one-piece barrel connector up to the shoulder. This acts to secure the sleeve in position, which prevents internal shifting of the compression sleeve, ensuring accuracy without interference. When a paintball barrel of the same mating design configuration as the internal bore of the connector is attached into the internal bore of the present invention to the point where it reaches the shoulder of the compression sleeve, it applies friction that locks the compression sleeve in position.

A further object of the invention is it is a small, compact system that fits in a pocket.

The fact that the present invention is not an incorporated component of any other system allows its compact size to be easily carried in a pocket and used throughout competition situations.

Yet another object of the invention is allows for quick and easy transitions between the use of compression or none.

The user has the ability to easily adjust the desired amount of compression against the paintball by simply changing the removable-insertable compression sleeve within the one-piece barrel connector, or simply removing the connector thereby eliminating the compression zone altogether.

Still yet another object of the invention is it allows for the cross use of various manufacturers' barrels.

The user is not restricted to a specific design, length or shape of barrel and can completely remove the optional compression zone, as desired, providing greater flexibility than where compression is integrated directly into that manufacturer's specific barrel. The paintball connector of this invention will accommodate a variety of barrels to be connected to the mating end of the one-piece variable bore paintball barrel connector system.

Other objects and advantages of the present invention will become apparent from the following descriptions, taken in connection with the accompanying drawings, wherein, by way of illustration and example, an embodiment of the present invention is disclosed.

In accordance with a preferred embodiment of the invention, there is disclosed this apparatus is a variable bore paintball barrel connector system comprising: a one-piece connector unit that joins the paintball marker with any mating barrel, a cylindrical compression sleeve that is inserted into the one-piece connector to provide the compression to the paintball, as an independent device that is not an incorporated component of any barrel nor marker unit, this allows for quick and easy transitions between the use of compression, amount of compression, or no compression, and the compression sleeve has a raised lip on one edge that holds it in place to prevent it from slipping through the connector device The present invention may be made of known materials, such as aluminum, plastic, or titanium. The components of this invention may be manufactured by known methods such as machining or molding.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate understanding of the invention.

DETAILED DESCRIPTION OF THE PREFERRED EMBODIMENTS

Detailed descriptions of the preferred embodiment are provided herein. It is to be understood, however, that the apparatus of the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
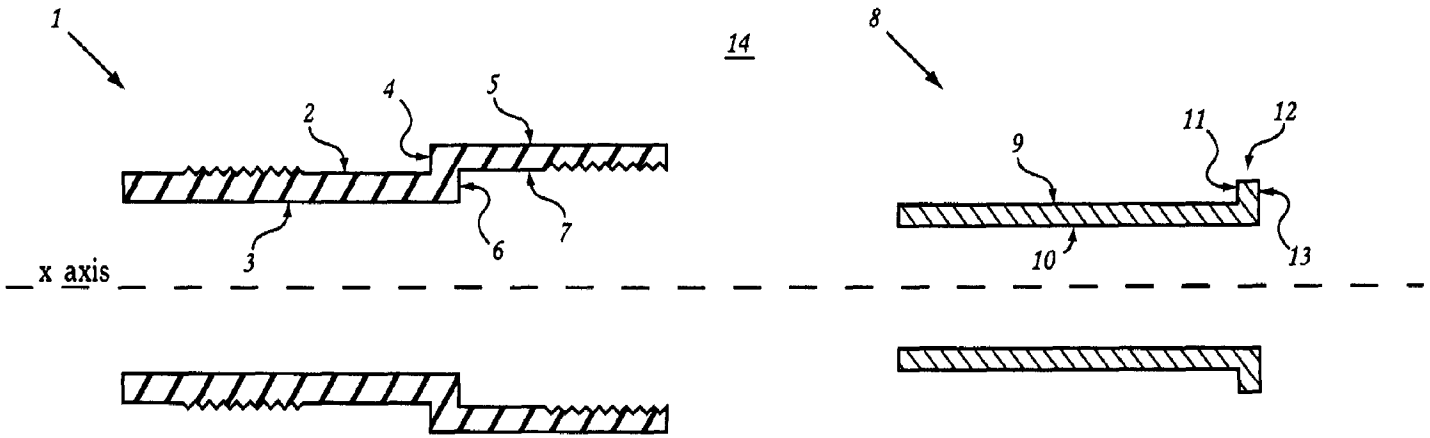
FIG. 1 is a cross-sectional side view of the one-piece variable bore paintball barrel connector, showing its axially aligned, axially centered internal bore and through-hole, along with its larger outside diameter and a smaller external protruding portion. It also shows a cross-sectional side view of the removable cylindrical compression sleeve as having an axially aligned, axially centered outside diameter, with a narrow shoulder of a larger diameter, and its centered hole which goes completely through the sleeve.

As shown in FIG. 1, the present invention, the variable bore paintball barrel connector system (14), comprising of a one-piece barrel connector (1), and a one-piece insertable removable compression sleeve (8), which can be removeably positioned between a paintball marker body and a paintball barrel. The one-piece barrel connector (1) has a protruding external portion (2), which is axially aligned and axially centered. In example, the protruding external portion (2) is of a design configuration and length that will allow it to removably attach into any paintball marker body, with the same mating design configuration. The protruding external portion (2) of the one-piece barrel connector (1) is also smaller than the outside diameter (5) of the barrel connector (1), between the outside diameter (5) and the protruding external portion (2) is the outside diameter wall (4).

The outside diameter (5) is of a size that is large enough to permit an axially aligned axially centered internal bore (7), which is illustrated to represent any design configuration that will allow any paintball barrel with the same mating design configuration, regardless of manufacturer, to be removably attached into the internal bore (7) of the paintball barrel connector (1), which may or may not reach the internal bore's (7) bottom face (6). The one-piece barrel connector (1) also has an axially aligned axially centered through-hole (3), which is smaller than the external protruding portion (2) and the internal bore (7). Square to the internal bore (7) and the through hole (3) is the internal bore bottom face (6).

Also, shown in FIG. 1 is the cylindrical insertable-removable compression sleeve (8). The outside diameter (9) of the insertable-removable compression sleeve (8) is axially aligned, axially centered and slightly smaller than the through-hole (3) of the one-piece barrel connector (1). This permits the removable compression sleeve (8) to easily slide into the through-hole (3) of the one-piece barrel connector (1), until the inside shoulder face (11), which is square to the outside diameter (9) and also the narrow outside diameter shoulder (12) which together form the raised lip of the removable compression sleeve (8) which comes into contact with the bottom bore face (6) of the one-piece barrel connector (1). Since the size of the narrow outside diameter shoulder (12) of the removable compression sleeve (8) is smaller than the size of the internal bore (7) of the barrel connector (1), it will not cause any interference when the removable compression sleeve (8) is removably inserted into the though-hole (3) of the barrel connector (1). The outside shoulder face (13) of the removable compression sleeve (8) is parallel to the inside shoulder face (11) and is square to the axially aligned axially centered through-hole (10) of the removable compression sleeve (8). The through-hole (10) of the removable compression sleeve (8) is of the size required to place the predetermined amount of compression against a paintball as it travels through the through-hole (10) of the removable compression sleeve (8).

Figure 2:
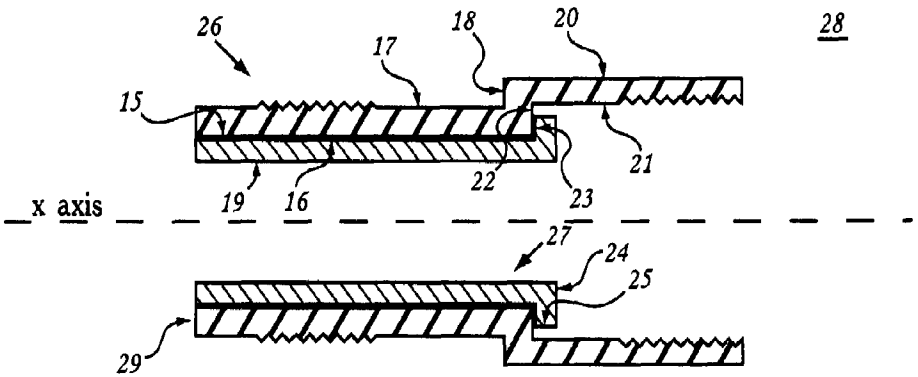
FIG. 2 is a cross-sectional side view of the one-piece paintball barrel connector system, with the removable compression sleeve inserted into the one-piece connector up to the shoulder of the sleeve in a first configuration.

FIG. 2 shows the variable bore paintball barrel connector system (28), which has its outside diameter (16) of the removable compression sleeve (27) inserted into the through-hole (15) of the one-piece paintball barrel connector (26) to the point where the inside shoulder face (23) contacts the bore's bottom face (22) thereby preventing the removable compression sleeve (27) from going any further into the through-hole (15) of the one-piece barrel connector (26). Since the size of the outside diameter shoulder (25) is smaller than the internal bore (21), there is no interference.

A paintball barrel of the same mating design configuration as the internal bore (21), being smaller than the outside diameter (20), can be removably connected into the internal bore (21) to the point where it places pressure against the removable compression sleeve's (27) outside shoulder face (24). This will lock both the paintball barrel and the removable compression sleeve (27) in place. The one-piece variable bore paintball barrel connector (26) may now be removably attached into the body of a paintball marker that has the same mating design configuration as the protruding external portion (17) of the one-piece paintball barrel connector (26). The one-piece barrel connector (26) may be securely attached into the paintball marker body up to a point where it may contact the outside diameter wall (18). The variable bore paintball barrel connector system (28) has now created an optional compression zone located between the paintball marker body and the paintball barrel. The connector system (28), as an independent self-contained device, is now automatically aligned and centered and ready to apply the desired amount of compression to the paintball after it is ejected from the paintball marker body, as it travels down the through-hole (19) of the removable compression sleeve (27), and prior to entering the paintball barrel.

Figure 2B:
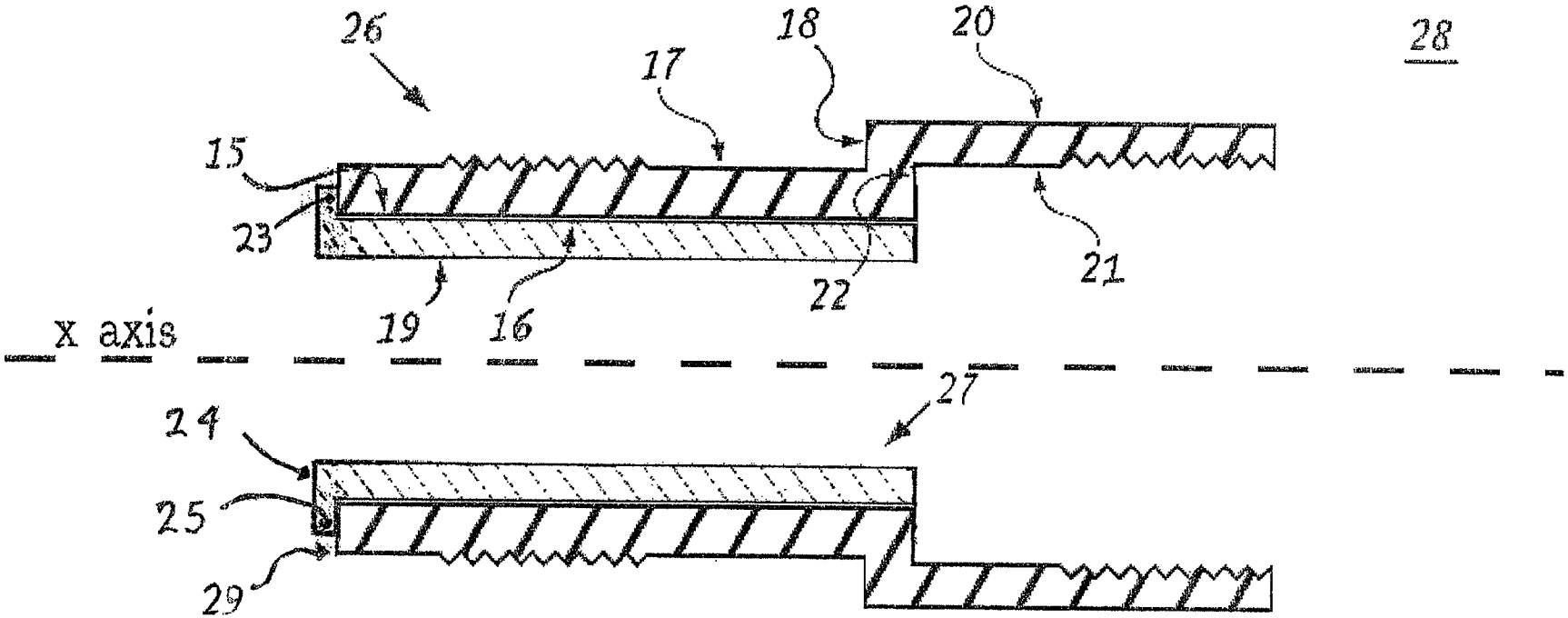
FIG. 2B is a cross-sectional side view of the one-piece paintball barrel connector system, with the removable compression sleeve inserted into the one-piece connector up to the shoulder of the sleeve in a second configuration.

As shown in FIG. 2B, the variable bore paintball barrel connector system (28) will also allow the removable compression sleeve (27) to be inserted into the through-hole (15) of the one-piece barrel connector (26) from the external protruding portion (17) side of the one-piece barrel connector (26) up to the point where the inside shoulder face (23) contacts the external protruding portion face (29) thereby preventing the removable compression sleeve (27) from going any further into the through-hole (15) of the one-piece barrel connector (26). Since the outside diameter shoulder (25) of the removable compression sleeve (27) is smaller than the external protruding portion (17) of the one-piece barrel connector (26) there will be no interference when the external protruding portion (17) is removably attached into the body of a paintball marker up to the point where friction is placed against the removable compression sleeve's (27) outside shoulder face (24). This will lock the removable compression sleeve in place inside the one-piece barrel connector which is now located inside the paintball marker body. A paintball barrel of the same mating design configuration as the internal bore (21) can now be removably connected into the internal bore (21) of the one-piece barrel connector (26) until it reaches the bore's bottom face (22), thereby locking the paintball barrel in place.

Figure 3:
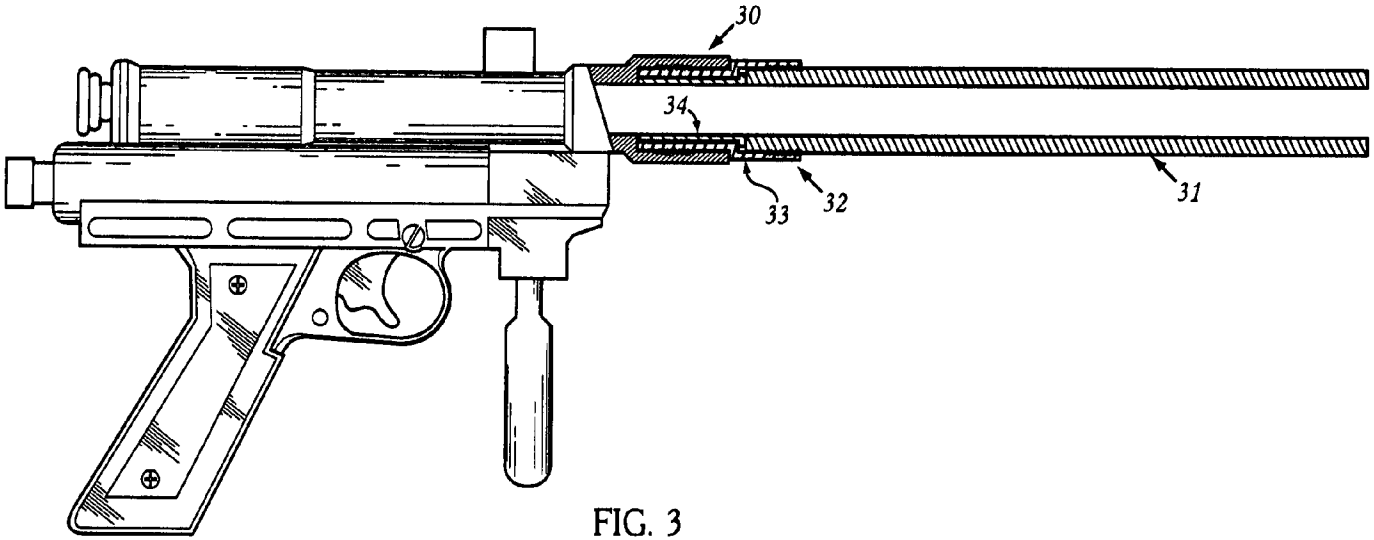
FIG. 3 is a side view of a paintball marker, showing a cross-sectional view of the paintball marker's internal bore end where it is showing the optional compression zone created when the variable bore paintball barrel connector system is attached to the paintball marker body in between the paintball marker body and a standard paintball marker barrel.

FIG. 3 shows a paintball marker body (30) paintball barrel (31) and is using the variable bore paintball barrel connector system (32) of the present invention. One end is removably attached into the paintball marker body (30) and a standard paintball barrel (31) is connected to the other end. The variable bore paintball barrel connector system (32) of the present invention consisting of the one piece barrel connector (33) which is removably attached to the paintball marker body (30) and the removable compression sleeve (34) which when inserted into the one piece barrel connector (33) and then locked in place by the standard paintball barrel (31) creates the optional compression zone located between the paintball marker body (30) and the paintball marker barrel (31).

Figure 3A:
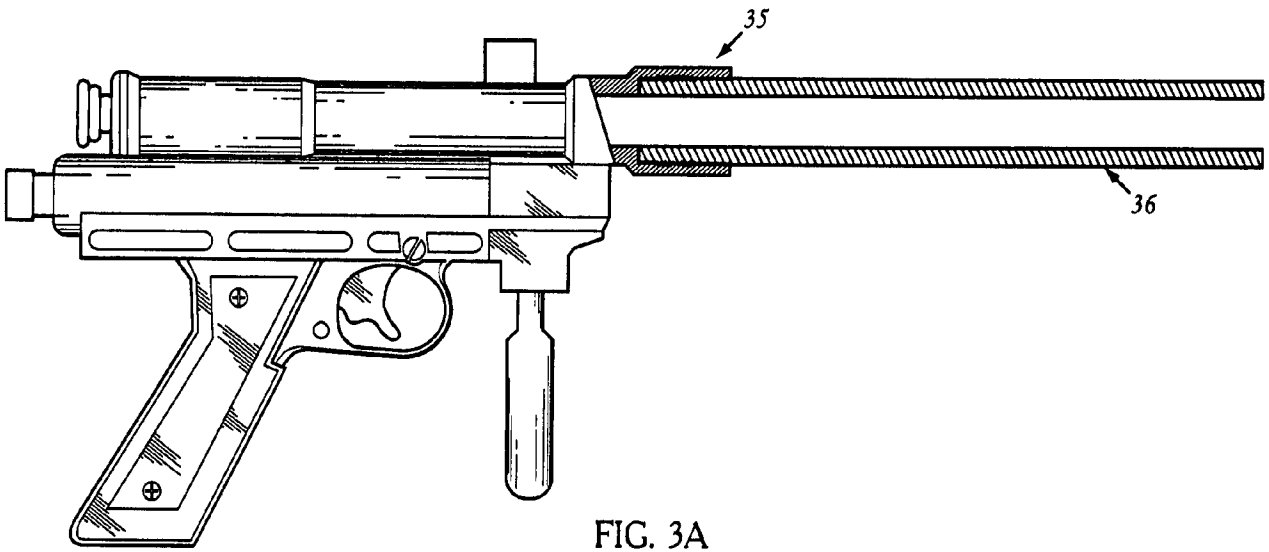

FIG. 3A shows that the user of the present invention can also as desired remove the variable bore paintball barrel connector system (32) as shown in FIG. 3, and then reconnect the same standard paintball barrel (36), see FIG. 3 (31) directly to the paintball marker body (35) thereby completely removing the variable bore paintball barrel connector system. from the equation while still able to maintain a fully functional paintball marker and barrel combination to meet the demand of the ever changing paintball competition environment, where compression may no longer be required.

Figure 4:
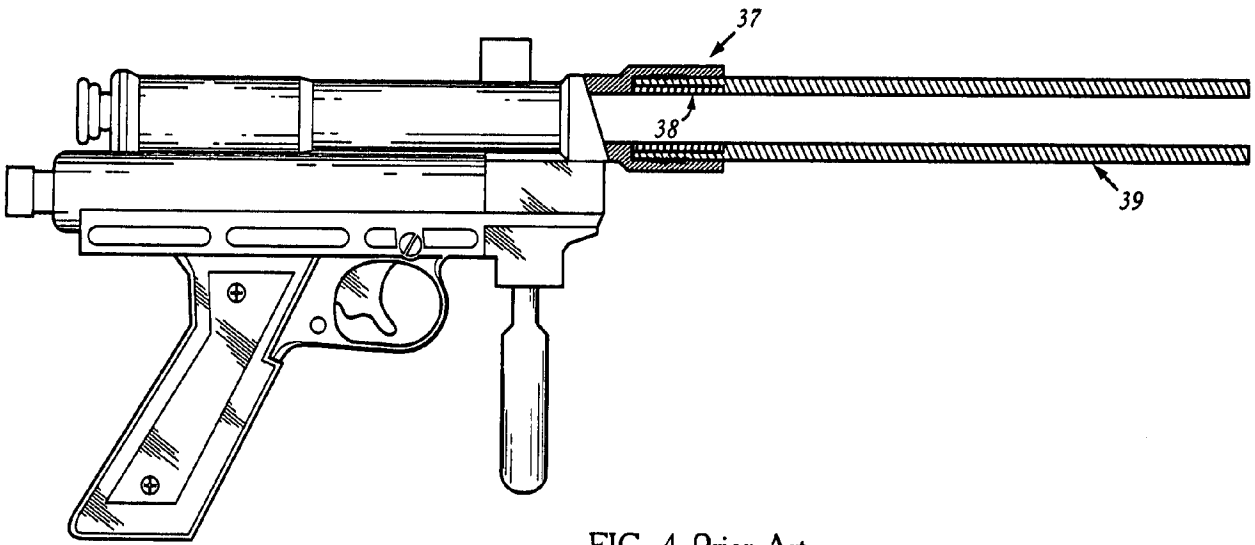
FIG. 4 Prior Art
FIG. 4 is a side view of a paintball marker, now showing a cross-sectional view of the paintball marker's end with a barrel that is of a prior-art design which uses a built-in compression choke.

FIG. 4 shows a paintball marker body (37) which has removably attached to it a paintball barrel with a built-in compression choke, also known as a choke barrel (39), as described to us in prior art. The choke-barrel (39) has the choke (38) inserted into the barrel itself. The user of the choke barrel (39) is required to, at all times, apply some level of compression to the paintball through the use of the choke (38).

Figure 4A:
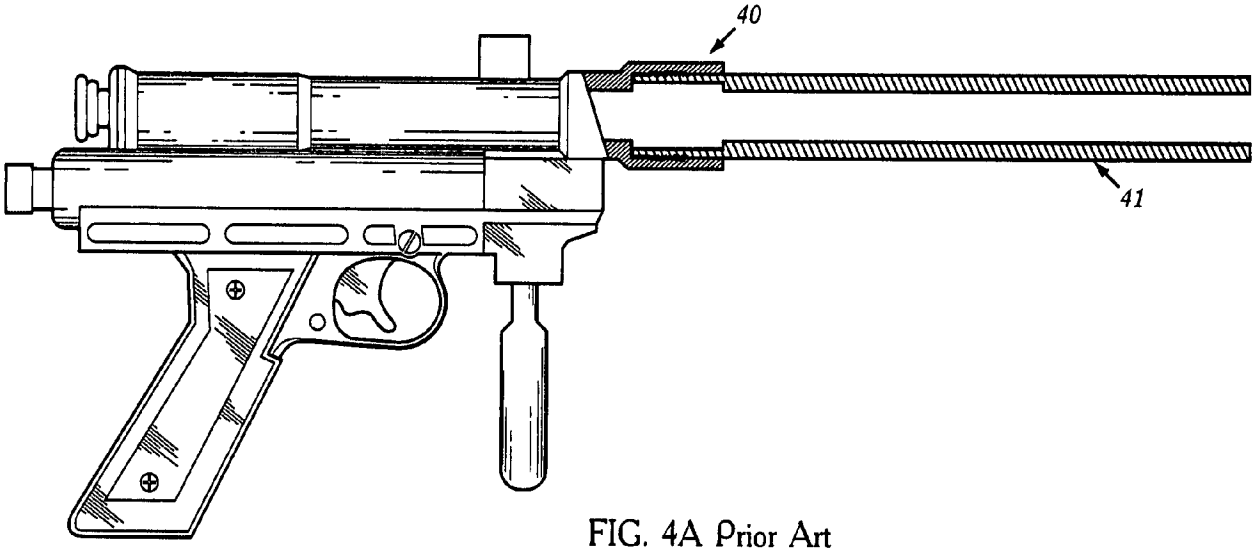
FIG. 4A Prior Art
FIG. 4A is a side view of a paintball marker, now showing a cross-sectional view of the paintball marker's end using a prior art design barrel with its compression choke removed, thus showing the irregular shape created inside of the barrel.

Shown in FIG. 4A, the irregular inside shape of a choke barrel (41) when connected to the paintball marker body (40) without its compression choke. This provides an irregular uneven internal surface for the paintball to travel through. This increases its chance of breaking, and allows the escape of gases around it, which further inhibits its effectiveness in competition. As described to us in prior-art this type of choke-barrel is of no use to a user who no longer needs to apply compression, and is left with the need to change to a standard barrel.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. An apparatus for use with a paintball marker having a barrel comprising:

a barrel connector unit having an external end adapted to be connected to the marker, the barrel connector unit further having a barrel connector end adapted to be connected to the barrel, wherein the external end has an internal diameter that is less than an internal diameter of the barrel connector end, the barrel connector unit further having a bore therethrough from the external end to the barrel connector end;

a compression sleeve, positioned in the bore; and a cooperative stop structure within the barrel connector unit wherein the compression sleeve is prevented from sliding completely through the barrel connecting unit, wherein the cooperative stop structure comprises a shoulder on the compression sleeve, and an internal face on the barrel connector unit, wherein the barrel connector unit end defines the internal face and wherein the shoulder engages the internal face when the sleeve is inserted into the bore in a first configuration, and wherein the cooperative stop structure also comprises the shoulder on the compression sleeve, and an external face on the barrel connector unit, wherein the external end defines the external face and wherein the shoulder engages the external face when the sleeve is inserted into the bore in a second configuration.

2. The apparatus of claim 1 wherein the compression sleeve comprises a plurality of compression sleeves, each compression sleeve having a different internal diameter.

3. The apparatus of claim 1 wherein the compression sleeve is a continuous cylinder.

4. The apparatus of claim 1 wherein the external end has an internal diameter and the compression sleeve has an external diameter, wherein the external diameter of the compression sleeve is slightly less than the internal diameter of the external end.

5. The apparatus of claim 1 wherein the compression sleeve has a length dimensioned such that wherein in the first configuration, the second end of the compression sleeve is proximate to the external face.

6. The apparatus of claim 1 wherein the compression sleeve has a length dimensioned such that wherein in the second configuration, the second end of the compression sleeve is proximate to the internal face.

7. An apparatus for use with a paintball marker having a barrel comprising:

a barrel connector unit having an external end having external threads adapted to mate with threads on the marker to connect the barrel connecting unit to the marker, the external end further having an inner diameter and an outer diameter, the external end defining an external face, the barrel connector unit further having a barrel connector end having internal threads adapted to mate with thread on the barrel to connect the barrel connecting unit to the barrel, the barrel connector end having an inner diameter and an outer diameter, the barrel connector end defining an internal face, wherein the internal diameter of the external end is less than the internal diameter of the barrel connector end, and the barrel connector unit further having a bore from the external end to the barrel connector end; and a compression sleeve having a continuous cylindrical shape, with a first end and a second end, the first end having a shoulder, wherein the compression sleeve is positioned in the barrel connecting unit in one of a first configuration and a second configuration, wherein in the first configuration, the shoulder engages the internal face, and wherein in the second configuration, the shoulder engages the external face.

8. The apparatus of claim 7 wherein the compression sleeve comprises a plurality of compression sleeves, each compression sleeve having a different internal diameter.

9. The apparatus of claim 7 wherein the external end has an internal diameter and the compression sleeve has an external diameter, wherein the external diameter of the compression sleeve is slightly less than the internal diameter of the external end.

10. The apparatus of claim 7 wherein the compression sleeve has a length dimensioned such that wherein in the first configuration, the second end of the compression sleeve is proximate to the external face.

11. The apparatus of claim 7 wherein the compression sleeve has a length dimensioned such that wherein in the second configuration, the second end of the compression sleeve is proximate to the internal face.

12. A kit for use with a paintball marker for use with paintballs comprising:

a barrel connector unit, having an external end defining an external face and a barrel connector end defining an internal face, wherein the external end is adapted to be connected to the marker, and the external end has an internal diameter that is less than an internal diameter of the barrel connector end; and a compression sleeve having a continuous cylindrical shape, with a first end and a second end, the first end having a shoulder, wherein the compression sleeve is positioned in the barrel connector unit, wherein the compression sleeve comprises a plurality of compression sleeves, each compression sleeve having a different internal diameter to accommodate differently sized paintballs, wherein the barrel connector unit and one of the compression sleeves positioned in the barrel connector unit is capable of being operably connected to the marker independent of additional structure, wherein the compression sleeve is positioned in the barrel connecting unit in one of a first configuration and a second configuration, wherein in the first configuration, the shoulder engages the internal face, and wherein in the second configuration, the shoulder engages the external face.

13. The kit of claim 12 further including a cooperative stop structure operably associated with the barrel connector unit and the compression sleeve wherein the compression sleeve is prevented from sliding completely through the barrel connecting unit.

14. The kit of claim 12 wherein barrel connector end having internal threads adapted to mate with threads on a barrel to connect the barrel connecting unit to the barrel.

* * * * *